US006302194B1

(12) United States Patent
Kastner et al.

(10) Patent No.: US 6,302,194 B1
(45) **Date of Patent: *Oct. 16, 2001**

(54) PIPE WITH RIBS ON ITS INNER SURFACE FORMING A MULTIPLE THREAD AND STEAM GENERATOR FOR USING THE PIPE

(75) Inventors: Wolfgang Kastner, Herzogenaurach; Wolfgang Köhler, Kalchreuth; Eberhard Wittchow, Erlangen, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 08/151,257

(22) Filed: Nov. 12, 1993

Related U.S. Application Data

(63) Continuation-in-part of application No. 08/050,714, filed on Apr. 21, 1993, now abandoned, which is a continuation of application No. 07/851,490, filed on Mar. 13, 1992, now abandoned.

(30) Foreign Application Priority Data

Mar. 13, 1991 (EP) ..... 91103866

(51) Int. Cl.[7] ..... F28F 1/40
(52) U.S. Cl. ..... 165/133; 165/184; 122/6 A
(58) Field of Search ..... 165/184, 179, 165/133; 122/6 A

(56) References Cited

U.S. PATENT DOCUMENTS 2,220,944 * 11/1940 Murray, Jr. ..... 165/181 X
2,279,548 * 4/1942 Bailey ..... 165/179 X
3,088,494 * 5/1963 Koch et al. ..... 165/179 X
4,118,944 * 10/1978 Lord et al. ..... 165/179 X
4,124,064 * 11/1978 Jabsen et al. ..... 165/69
4,191,133 * 3/1980 Stevens ..... 165/179 X
4,402,359 * 9/1983 Carnavos et al. ..... 165/179 X
4,480,684 * 11/1984 Onishi et al. ..... 165/179 X
4,660,630 * 4/1987 Cunningham et al. ..... 165/133
5,662,070 * 9/1997 Kastner et al. ..... 122/6 A

FOREIGN PATENT DOCUMENTS

18807 * 10/1992 (WO) .

OTHER PUBLICATIONS

Les chaudiéres de 700 MW de la centrale de Cordemais, Revue Générale de Thermique No. 13, Jan. 1973, pp. 41–54 and the "Standards" Table concerning multi–rifled seamless boiler tubes.

* cited by examiner

*Primary Examiner*—Leonard Leo
(74) *Attorney, Agent, or Firm*—Herbert L. Lerner; Laurence A. Greenberg; Werner H. Stemer

(57) ABSTRACT

A pipe includes a pipe wall having an inner wall surface. Ribs are disposed on the inner wall surface forming a multiple thread. The ribs define a mean inside pipe diameter and the ribs have a lead which is equal to between 0.6 and 0.9 times the square root of the mean inside pipe diameter. Such pipes may be used in a fossil-fuel steam generator, a solar-heated steam generator, or a heated steam generator serving as a waste-heat steam generator, a heat exchanger or a steam generator for absorbing after-heat in a nuclear power plant.

26 Claims, 3 Drawing Sheets

PIPE WITH RIBS ON ITS INNER SURFACE FORMING A MULTIPLE THREAD AND STEAM GENERATOR FOR USING THE PIPE

CROSS-REFERENCE TO RELATED APPLICATIONS

This is a continuation-in-part of application Ser. No. 08/050,714, filed Apr. 21, 1993 now abandoned, which was a file wrapper continuation of application Ser. No. 07/851, 490, filed Mar. 13, 1992 now abandoned.

BACKGROUND OF THE INVENTION

Field of the Invention

The invention relates to a pipe having ribs on its inner surface forming a multiple thread, and steam generators and heat transfer systems using the pipe.

Pipes that are ribbed on the inner surface have been used for some time in steam generators, in order to control major thermal strains in the combustion chamber. For instance, an article entitled "Zwangdurchlaufkessel für Gleitdruckbetrieb mit Vertikaler Brennkammerberohrung" [Forced Circulation Boiler for Sliding Pressure Operation with Vertical Combustion Chamber Piping] by H. Juzi, A. Salem and W. Stocker, published in VGB Kraftwerkstechnik [VGB Power Plant Industry] 64, pages 292–302, describes on page 294 thereof, among other things, that on one hand in a region of high combustion chamber thermal strain with smooth evaporator pipes, film evaporation must be expected within a wide range of subcritical pressures, yet on the other hand with pipes which are ribbed on the inner surface, the film evaporation is limited to a pressure range between approximately 206 bar and the critical pressure.

Due to the film of vapor between the metal pipe wall and the liquid phase of the heat absorption medium, the film evaporation hinders the heat transfer, so that the pipe wall temperature rises sharply in the region of the film evaporation. In steam generators with forced circulation of a coolant, the film evaporation occurs practically only in the region in which both the liquid and the vapor phase of the coolant occur simultaneously. Tests have confirmed that with smooth-walled pipes, film evaporation must be expected even with low steam content, and that the evaporation shifts to higher steam contents when pipes that are ribbed on the inner surface are used. This shift simultaneously reduces the extent of the undesired temperature increase in the metal pipe wall.

As can be found both in the above-cited article and in a report presented to The International Heat Transfer Conference in Tokyo, September 1974, paper PGTP 73–54, pages 14–21, the desired shift in the film boiling in commercially available internally grooved pipes, occurs only at relatively high mass flow densities and high coolant speeds.

SUMMARY OF THE INVENTION

It is accordingly an object of the invention to provide a pipe with ribs on its inner surface forming a multiple thread and a steam generator for using the pipe, which overcome the hereinafore-mentioned disadvantages of the heretofore-known devices of this general type and which have an improved geometry that enables their use independently of the mass flow rate density.

With the foregoing and other objects in view, there is provided, in accordance with the invention, a pipe, comprising a pipe wall having an inner wall surface, and ribs disposed on the inner wall surface forming a multiple thread, the ribs defining a mean inside pipe diameter measured in meters, and the ribs having a lead measured in meters and being equal to between 0.6 and 0.9 times the square root of the mean inside pipe diameter and, preferably between 0.8 and 0.9 times the square root.

In accordance with another feature of the invention, the ribs have a radial height being at least substantially 0.04 times the mean inside pipe diameter.

In accordance with a further feature of the invention, the mean inside pipe diameter is greater than substantially 27 mm.

In accordance with an added feature of the invention, the pipe wall defines a pipe axis, the ribs have sides, as seen in radial direction, and the sides form an angle of substantially from 80 to 90° with the pipe axis.

In accordance with an additional feature of the invention, the pipe wall has an interior, the ribs have sides as seen in radial direction, the ribs have free surfaces facing the interior, the ribs have a rounded transition from the sides to the inner wall surface, and the free surfaces have sharp edges.

In accordance with yet another feature of the invention, the pipe wall encloses a space having a circular cross section except for the ribs, and the pipe wall has an outer jacket with an elliptical or polygonal cross section or an outer jacket with at least one longitudinal rib to be welded to a neighboring pipe or to a longitudinal rib of a neighboring pipe or to another structural part.

In accordance with yet a further feature of the invention, the pipe wall is formed of ferritic material.

In accordance with yet an added feature of the invention, the pipe wall has a pipe axis, the ribs have sides as seen in radial direction, and the sides form a lead angle of less than substantially 60° with a plane perpendicular to the pipe axis.

In accordance with yet an additional feature of the invention, the mean inside pipe diameter is substantially from 30 to 40 mm.

In accordance with again another feature of the invention, the mean inside pipe diameter is substantially 40 mm, the pipe wall has a pipe axis, the ribs have sides as seen in radial direction, and the sides form a lead angle of substantially 55° with a plane perpendicular to the pipe axis.

With the objects of the invention in view, there is also provided a fossil-fuel steam generator, comprising a plurality of pipes being constructed according to the invention, functioning the same and being welded to walls of a combustion chamber.

In accordance with again a further feature of the invention, the pipes are disposed vertically.

With the objects of the invention in view, there is additionally provided a solar-heated steam generator, comprising pipes being constructed according to the invention and being disposed horizontally or at an incline.

With the objects of the invention in view, there is furthermore provided a heated steam generator serving as a waste-heat steam generator, a heat exchanger or a steam generator for absorbing after-heat in a nuclear power plant.

Pipes which are constructed and used in accordance with the invention are highly advantageous, because they permit low axial flow speeds without the harmful occurrence of film boiling, so that the pressure loss of the coolant in the pipe from friction is quite low, with a virtually unchanged geodetic pressure loss. As a result, in an unexpectedly advantageous way, there is a simultaneous reduction in the temperature differences at the end of the pipe occurring between spatially parallel pipes from the unavoidably unequal thermal output. As tests have shown, this effect ensues to a satisfactory extent if a coolant which ideally follows the rib shape and flows at a slow axial speed of 1 m/s, is exposed on its outside to a calculated centrifugal acceleration that is 2½ times greater than the acceleration due to gravity, because of the swirl motion imposed upon it.

Other features which are considered as characteristic for the invention are set forth in the appended claims.

Although the invention is illustrated and described herein as embodied in a pipe with ribs on its inner surface forming a multiple thread and a steam generator for using the pipe, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENT

Figure 1:
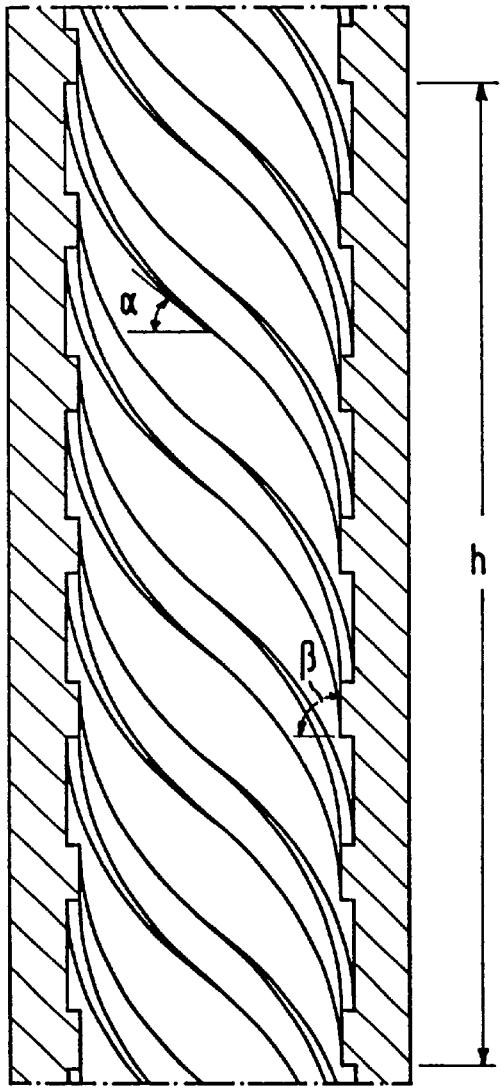
FIG. 1 is a diagrammatic, longitudinal-sectional view of a short length of a pipe according to the invention.

Referring now to the figures of the drawing in detail and first, particularly, to FIG. 1 thereof, there is seen a pipe, preferably of ferritic steel, which is provided with ribs on its inner surface. Each of the ribs is disposed along a helical line. The ribs form an angle a with planes that are perpendicular to the longitudinal axis of the pipe. As seen in FIGS. 2–6, the ribs also have a height H in the radial direction, which is at least 0.04 times a mean inside diameter d of the pipe. The mean diameter d intersects the ribs at approximately half the radial height. The mean diameter d may be defined as the pitch diameter, the average between the minor diameter and the major diameter. The helical lines that the ribs follow along have a lead h, defined for the internal thread (lead h is the distance an imaginary screw in the thread would advance in one turn).

Figure 2:
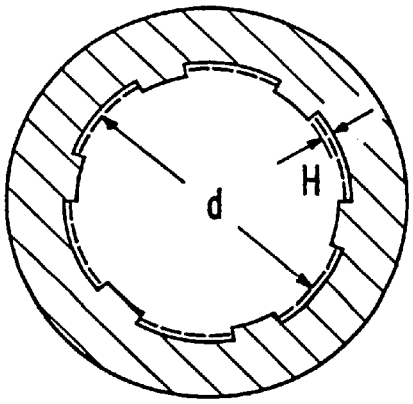
FIGS. 2–6 are cross-sectional views of pipes according to the invention.

In the exemplary embodiment of FIG. 2, both the transition from the inner surface of the pipe wall to the sides of the ribs and the transition from the sides of the ribs to the surface or edge thereof oriented toward the free interior of the pipe, are virtually sharp-edged or sharp-cornered. In this version, both the outer jacket of the pipe and the inner wall surface are of circular cross section, so that the pipe wall forms a circular ring as seen in cross section.

Figure 3:
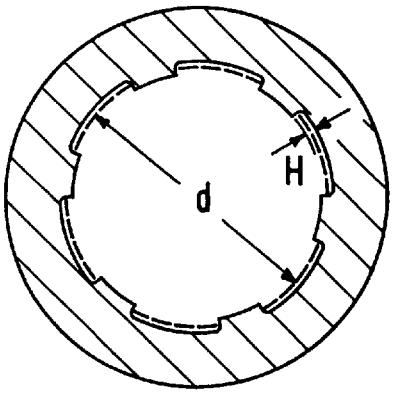

The exemplary embodiment of FIG. 3 departs from that of FIG. 2 only due to the fact that the transition from the inner pipe wall surface to the sides of the ribs is rounded in each case.

Figure 4:
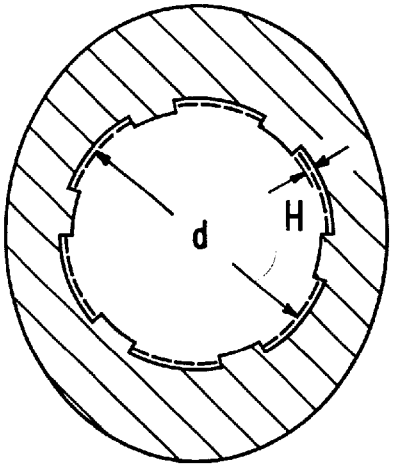
Figure 5:
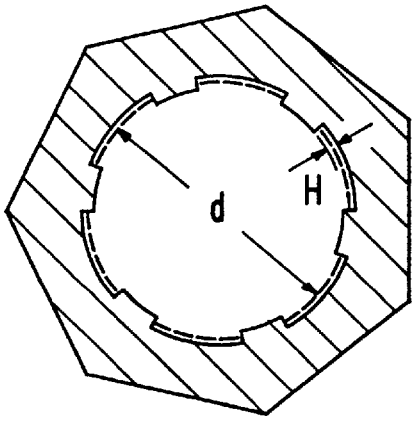
Figure 6:
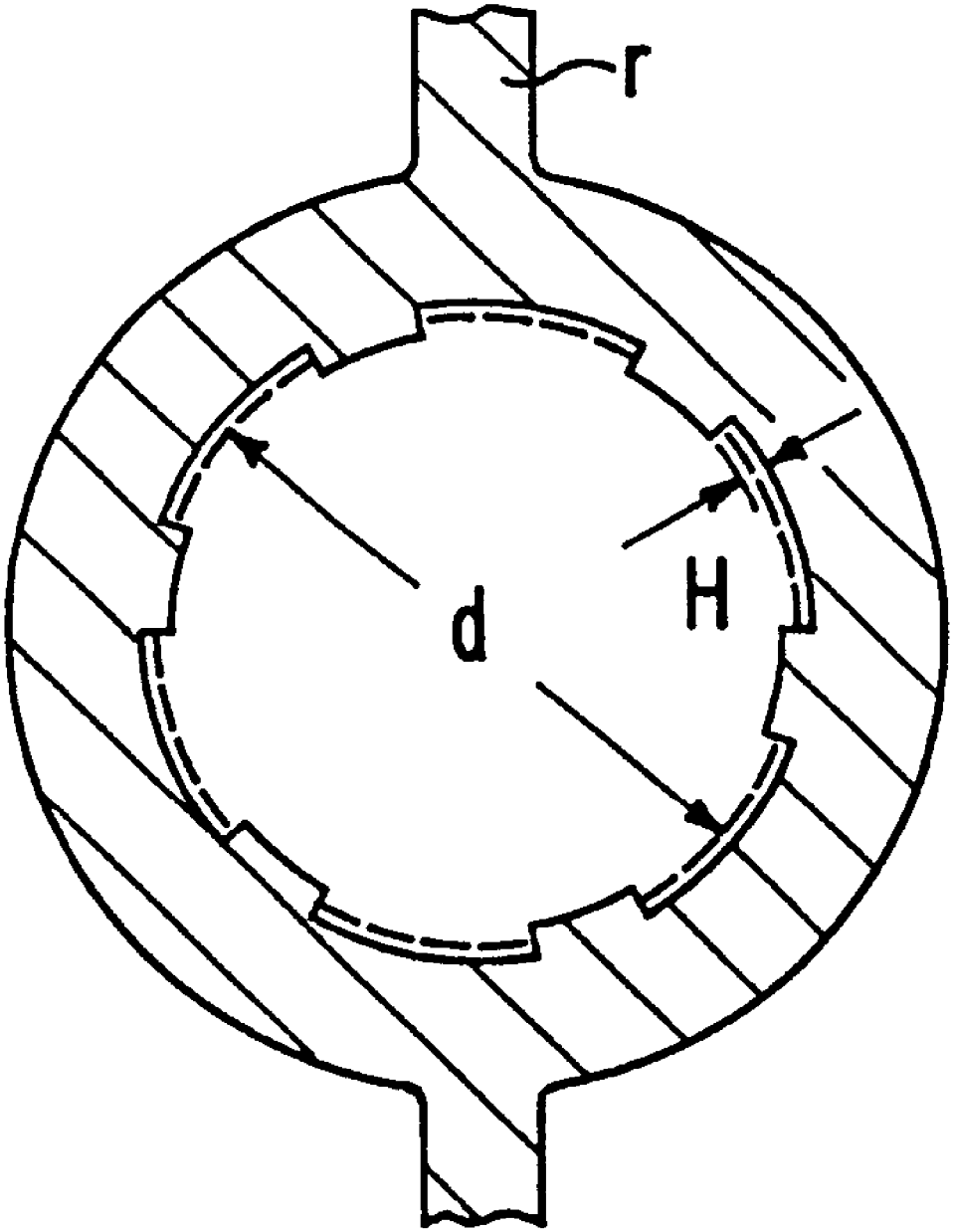

On one hand, the exemplary embodiments of FIGS. 4–6 have a sharp-edged construction of the ribs, corresponding to the exemplary embodiment of FIG. 2. On the other hand, in the exemplary embodiment of FIG. 4 the outer jacket is elliptical in cross section, while in FIG. 5 the outer jacket is a heptagonal in cross section. The deviation from the circular shape on the part of the outer jacket is advantageous in certain applications, in which vertical or horizontal pipes that are located side by side are welded tightly together over their entire length. In the embodiment of FIG. 6, the outer jacket therefore has at least one longitudinal rib that can be welded to a neighboring pipe or to a longitudinal rib of a neighboring pipe or to some other structural part.

Practical embodiments of the pipes that are constructed according to the invention have diameters d>27 mm, and in the radial direction the sides of the ribs preferably enclose an angle of 80 to 90° with the pipe axis. In pipes according to the invention, the angle $\alpha$ is smaller than 60° and at a mean inside diameter d of 40 mm it is preferably approximately 55° in size.

When the pipes according to the invention are used to construct a forced circulation boiler, in which a plurality of identically functioning pipes are welded to walls of a combustion chamber and form part of a steam generator, the pipes are disposed vertically side by side and are welded to one another in gas-tight fashion over their entire length. In order to absorb a substantial portion of the heat produced in the combustion chamber, the pipes conduct a flow of water through them, as a coolant. This water is intended to be evaporated according to given specifications, so that a region is necessarily created inside the pipes, in which water and water vapor exist side by side, at the same temperature and at the same pressure. The steam content in the mixture then rises from 0 up to 100%.

Due to the ribs provided on the inner surface of the pipes, a swirling pulse is imparted to the flowing water, and as a result a rotation of the body of water about its own axis is superimposed on the axial flow. In previously conventional applications, the axial flow speed of the coolant was set at several meters per second, and due to that provision the development of a film of vapor between the inner pipe wall surface and the body of water was shifted in the direction of high steam content of the mixture. At these high axial flow speeds, such vapor films, that are also known as "film boiling", occur approximately in the region in which the coolant mixture includes 80% steam and 20% liquid. However, due to the high axial flow speed, a correspondingly high friction of the coolant against the pipe walls causes high pressure losses between where the coolant is fed into the pipes and where the steam emerges from the pipes. Such an occurrence has proved to be very disadvantageous, because the pressure loss caused by friction increases the temperature differences in the flows of steam emerging from the various pipes.

It has been surprisingly discovered that at comparatively low axial flows speeds and with a calculated centrifugal acceleration of the flowing medium on the order of magnitude of 2½ times the acceleration due to gravity, which occurs at a calculated flow speed of 1 m/s, the pressure losses due to friction in the pipes become so small that with virtually unchanged geodetically dictated pressure losses, the temperature differences among the vapor flows emerging from the various pipes are unexpectedly small.

Assuming a speed of v=1 m/s and a centrifugal acceleration $a_z$ of approximately 2.5 g, a certain proportional range for the lead h can be ascertained as a function f(d), with the following terms having the meanings given below:

$$v\left[\frac{m}{s}\right] = \text{axial flow speed}$$

$$h[m] = \text{lead of the ribs}$$

-continued $$U\left[\frac{1}{s}\right] = \text{revolutions of the flowing coolant}$$

$$\omega\left[\frac{1}{s}\right] = \text{angular speed of the flowing coolant}$$

$$d[m] = \text{mean inside diameter}$$

$$a_z\left[\frac{m}{s^2}\right] = \text{centrifugal acceleration}$$

$$g\left[\frac{m}{s^2}\right] = \text{acceleration due to gravity.}$$

If slip is ignored, the where $$v = h \cdot U; \text{ where } U = \frac{\omega}{2\pi}$$

$$v = h \cdot \frac{\omega}{2\pi} \rightarrow \omega = \frac{2\pi v}{h}; \text{ since}$$

$$a_z = \frac{d}{2}\omega^2 \rightarrow, \text{ then it is also } = \frac{d}{2}\left(\frac{2\pi v}{h}\right)^2 \text{ where}$$

$$a_z \geq 2.5 \text{ g and } v = 1\left[\frac{m}{s}\right]; \text{ it follows that}$$

$$2.5 \text{ g} \leq \frac{d}{2}\left(\frac{2\pi \cdot 1}{h}\right)^2 = \frac{d \cdot 4 \cdot \pi^2}{2 \cdot h^2}$$

$$h^2 \leq \frac{d \cdot 4 \cdot \pi^2}{2 \cdot 2.5 \cdot g}$$

$$h \leq \frac{2 \cdot \pi}{\sqrt{5\,\text{g}}} \cdot \sqrt{d} = 0.897\sqrt{d} \approx 0.9\sqrt{d}$$

Pipes are used in which the lead h of the ribs is upward of 0.6 times and at most equal to 0.9 times the square root of the mean inside pipe diameter d. If the proportionality constant of approximately 0.9 is used and an axial flow speed of 1 m/s is assumed, a calculated centrifugal acceleration $a_z$ on the order of 25 m/s$^2$ can be expected, so that if this relationship defined by the lead and the pipe diameter is adhered to, the above-described positive effect ensues.

This structure of the pipes also enables their use in fossil-fueled steam generators, with low flow speeds of the coolant in the evaporator.

The advantageous properties of the pipes according to the invention can moreover be exploited in solar-heated steam generator as well, although in that case the pipes are typically disposed horizontally or in an inclined manner.

The use of the pipes according to the invention in waste heat steam generators or heat exchangers, or in steam generator for absorbing post-decay heat or after-heat in nuclear power plants, is also often advantageous.

It is important to note that the definitions regarding the lead and diameters in the claims and throughout this application are in mks units, i.e. in meters (or mm) in the claims.

What is claimed is:

1. A pipe, comprising a pipe wall having an inner wall surface, and ribs disposed on said inner wall surface forming a multiple thread, said ribs defining a mean inside pipe diameter d measured in meters, and said ribs having a lead h measured in meters, said lead h being equal to between 0.8 and 0.9 times the square root of the mean inside pipe diameter d.

2. The pipe according to claim 1, wherein said ribs have a radial height being at least substantially 0.04 times the mean inside pipe diameter.

3. The pipe according to claim 1, wherein the mean inside pipe diameter is greater than substantially 0.027 m.

4. The pipe according to claim 1, wherein said pipe wall defines a pipe axis, said ribs have sides, as seen in radial direction, and said sides form an angle of substantially from 80 to 90° with the pipe axis.

5. The pipe according to claim 1, wherein said pipe wall has an interior, said ribs have sides as seen in radial direction, said ribs have free surfaces facing the interior, said ribs have a rounded transition from said sides to said inner wall surface, and said free surfaces have sharp edges.

6. The pipe according to claim 1, wherein said pipe wall encloses a space having a circular cross section except for said ribs, and said pipe wall has an outer jacket with an elliptical cross section.

7. The pipe according to claim 1, wherein said pipe wall encloses a space having a circular cross section except for said ribs, and said pipe wall has an outer jacket with a polygonal cross section.

8. The pipe according to claim 1, wherein said pipe wall encloses a space having a circular cross section except for said ribs, and said pipe wall has an outer jacket with at least one longitudinal rib to be welded to a neighboring pipe.

9. The pipe according to claim 1, wherein said pipe wall is formed of ferritic material.

10. The pipe according to claim 1, wherein said pipe wall has a pipe axis, said ribs have sides as seen in radial direction, and the sides form a lead angle of less than substantially 60° with a plane perpendicular to the pipe axis.

11. The pipe according to claim 1, wherein the mean inside pipe diameter is substantially from 0.03 to 0.04 m.

12. The pipe according to claim 1, wherein the mean inside pipe diameter is substantially 0.04 m, said pipe wall has a pipe axis, said ribs have sides as seen in radial direction, and the sides form a lead angle of substantially 55° with a plane perpendicular to the pipe axis.

13. A fossil-fuel steam generator, comprising, a plurality of identically functioning pipes, each of said pipes having a pipe wall with an inner wall surface, and ribs disposed on said inner wall surface forming a multiple thread, said ribs defining a mean inside pipe diameter d measured in meters, and said ribs having a lead h measured in meters, said lead h being equal to between 0.8 and 0.9 times the square root of the mean inside pipe diameter d.

14. The fossil-fuel steam generator according to claim 13, wherein said pipes are disposed vertically.

15. A solar-heated steam generator, comprising a plurality of pipes, each of said pipes having a pipe wall with an inner wall surface, and ribs disposed on said inner wall surface forming a multiple thread, said ribs defining a mean inside pipe diameter d measured in meters, and said ribs having a lead h measured in meters, said lead h being equal to between 0.8 and 0.9 times the square root of the mean inside pipe diameter d.

16. The solar-heated steam generator according to claim 15, wherein said pipes are disposed horizontally.

17. The solar-heated steam generator according to claim 15, wherein said pipes are inclined.

18. A waste heat steam generator, comprising a plurality of pipes, each of said pipes having a pipe wall with an inner wall surface, and ribs disposed on said inner wall surface forming a multiple thread, said ribs defining a mean inside pipe diameter d measured in meters, and said ribs having a lead h measured in meters, said lead being equal to between 0.8 and 0.9 times the square root of the mean inside pipe diameter.

19. A heat exchanger, comprising a plurality of pipes, each of said pipes having a pipe wall with an inner wall surface, and ribs disposed on said inner wall surface forming a multiple thread, said ribs defining a mean inside pipe diameter d measured in meters, and said ribs having a lead h measured in meters, said lead being equal to between 0.8 and 0.9 times the square root of the mean inside pipe diameter.

20. A heated steam generator for absorbing after-heat in a nuclear power plant, comprising a plurality of pipes, each of said pipes having a pipe wall with an inner wall surface, and ribs disposed on said inner wall surface forming a multiple thread, said ribs defining a mean inside pipe diameter d measured in meters, and said ribs having a lead h measured in meters, said lead being equal to between 0.8 and 0.9 times the square root of the mean inside pipe diameter d.

21. A pipe, comprising a pipe wall having an inner wall surface, and ribs disposed on said inner wall surface forming a multiple thread, said ribs defining a mean inside pipe diameter d measured in meters, and said ribs having a lead h measured in meters, said lead h being equal to substantially 0.9 times the square root of the mean inside pipe diameter d.

22. A fossil-fuel steam generator, comprising a plurality of identically functioning pipes, each of said pipes having a pipe wall with an inner wall surface, and ribs disposed on said inner wall surface forming a multiple thread, said ribs defining a mean inside pipe diameter d measured in meters, and said ribs having a lead h measured in meters, said lead h being equal to substantially 0.9 times the square root of the mean inside pipe diameter d.

23. A solar-heated steam generator, comprising a plurality of pipes, each of said pipes having a pipe wall with an inner wall surface, sand ribs disposed on said inner wall surface forming a multiple thread, said ribs defining a mean inside pipe diameter d measured in meters, and said ribs having a lead h measured in meters, said lead h being equal to substantially 0.9 times the square root of the mean inside pipe diameter d.

24. A waste heat steam generator, comprising a plurality of pipes, each of said pipes having a pipe wall with an inner wall surface, and ribs disposed on said inner wall surface forming a multiple thread, said ribs defining a mean inside pipe diameter d measure in meters, and said ribs having a lead h measured in meters, said lead being equal to substantially 0.9 times the square root of the mean inside pipe diameter.

25. A heat exchanger, comprising a plurality of pipes, each of said pipes having a pipe wall with an inner wall surface, and ribs disposed on said inner wall surface forming a multiple thread, said ribs defining a mean inside pipe diameter d measured in meters, and said ribs having a lead h measured in meters, said lead being equal to substantially 0.9 times the square root of the mean inside pipe diameter.

26. A heated steam generator for absorbing after-heat in a nuclear power plant, comprising plurality of pipes, each of said pipes having a pipes wall with an inner wall surface and ribs disposed on said inner wall surface forming a multiple thread, said ribs defining a mean inside pipe diameter d measured in meters, and said ribs having a lead h measured in metes, said lead being equal to substantially 0.9 times the square root of the mean inside pipe diameter d.

* * * * *